US011674753B2

(12) United States Patent
Böhm

(10) Patent No.: US 11,674,753 B2
(45) Date of Patent: Jun. 13, 2023

(54) ROUND DRYER

(71) Applicant: Rösler Holding GmbH, Bad Staffelstein (DE)

(72) Inventor: Rüdiger Böhm, Untermerzbach (DE)

(73) Assignee: Rösler Holding GmbH, Bad Staffelstein (DE)

( * ) Notice: Subject to any disclaimer, the term of this patent is extended or adjusted under 35 U.S.C. 154(b) by 275 days.

(21) Appl. No.: 16/950,656

(22) Filed: Nov. 17, 2020

(65) Prior Publication Data

US 2021/0148636 A1 May 20, 2021

(30) Foreign Application Priority Data

Nov. 18, 2019 (DE) ..... 102019131105.5

(51) Int. Cl.

| | |
|---|---|
| ***F26B 15/26*** | (2006.01) |
| ***F26B 3/02*** | (2006.01) |
| ***F26B 21/02*** | (2006.01) |
| ***F26B 21/08*** | (2006.01) |
| ***F26B 25/10*** | (2006.01) |

(52) U.S. Cl.

CPC ..... *F26B 15/26* (2013.01); *F26B 3/02* (2013.01); *F26B 21/02* (2013.01); *F26B 21/08* (2013.01); *F26B 25/10* (2013.01)

(58) Field of Classification Search

CPC .. F26B 15/26; F26B 15/04; F26B 3/02; F26B 3/04; F26B 21/02; F26B 21/08; F26B 21/04; F26B 21/10; F26B 25/10

USPC ..... 34/147, 401

See application file for complete search history.

(56) References Cited

U.S. PATENT DOCUMENTS

| | | | | |
|---|---|---|---|---|
| 1,191,075 | A * | 7/1916 | Harrison | F26B 15/26 34/147 |
| 2,658,285 | A * | 11/1953 | Marius | F26B 25/10 34/233 |
| 3,315,492 | A * | 4/1967 | Dreksler | A23L 3/361 34/147 |
| 4,237,622 | A * | 12/1980 | Francis | F26B 15/26 34/147 |
| 4,444,248 | A * | 4/1984 | Hirosuke | F25D 13/067 432/121 |
| 5,495,864 | A | 3/1996 | Takagi et al. | |
| 5,513,445 | A * | 5/1996 | Farrag | B29C 49/42 34/582 |
| 6,457,255 | B1 | 10/2002 | Carlyle | |
| 2018/0201033 | A1* | 7/2018 | Wang | B41J 29/377 |

(Continued)

FOREIGN PATENT DOCUMENTS

| | | | |
|---|---|---|---|
| CN | 103727761 | A * | 4/2014 |
| CN | 103727761 | A | 4/2014 |
| CN | 206622961 | U | 11/2017 |

(Continued)

OTHER PUBLICATIONS

Search Report regarding corresponding EP App. No. 20206954.8, dated Apr. 15, 2021.

(Continued)

*Primary Examiner* — John P McCormack

(74) *Attorney, Agent, or Firm* — Dickinson Wright PLLC

(57) ABSTRACT

A round dryer for drying workpieces has a helically revolving workpiece passage in a work container and is provided with a heating device. The work container is closed at its upper side.

16 Claims, 2 Drawing Sheets

(56) References Cited

U.S. PATENT DOCUMENTS

Figure 1:
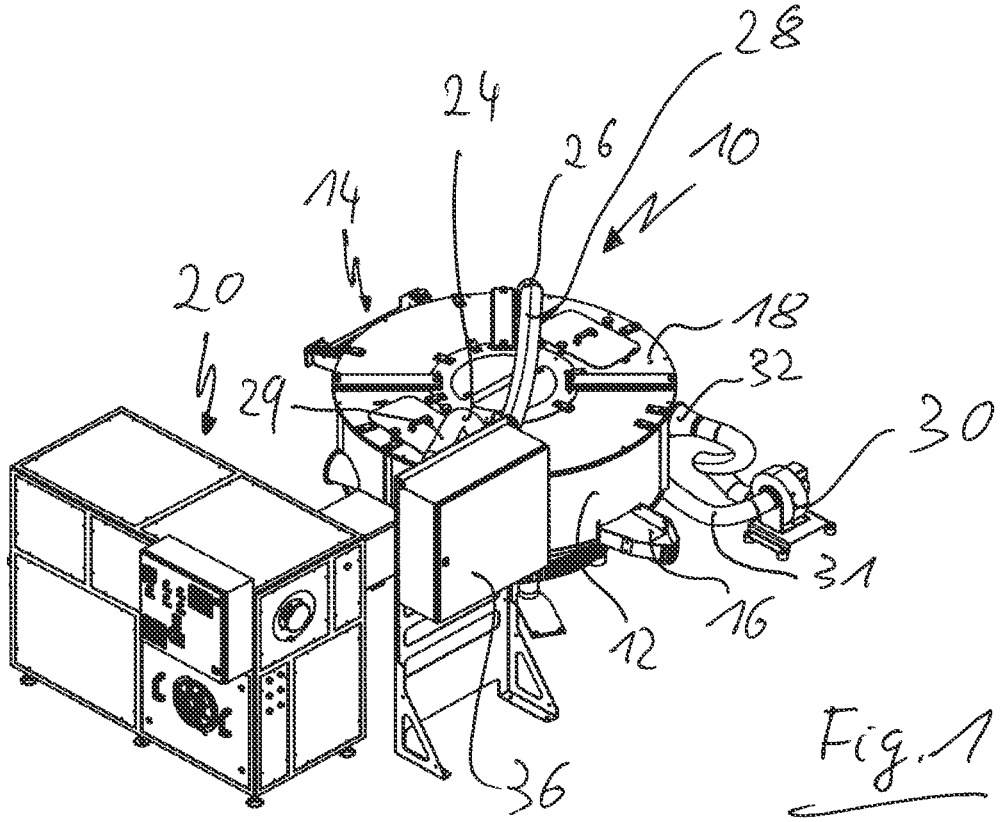

2022/0073856 A1* 3/2022 Pitkänen ..... C12M 29/06

FOREIGN PATENT DOCUMENTS

| | | | |
|---|---|---|---|
| DE | 3208321 | A1 | 7/1983 |
| DE | 4421505 | A1 | 12/1994 |
| EP | 0282937 | A2 | 9/1988 |
| EP | 0426045 | A1 | 5/1991 |
| EP | 1358966 | A2 | 11/2003 |
| FR | 2666639 | A1 | 3/1992 |
| GB | 715863 | A | 9/1954 |

OTHER PUBLICATIONS

Search Report regarding corresponding EP App. No. 20206954.8, dated Jul. 12, 2021.
Search Report regarding corresponding DE App. No. DE 10 2019 131 105.5; dated Sep. 2, 2020.

* cited by examiner

ROUND DRYER

CROSS-REFERENCE TO RELATED APPLICATIONS

This patent application claims the priority of German Application No. 102019131105.5, filed Nov. 18, 2019, which is incorporated herein by reference in its entirety.

The invention relates to a round dryer for drying workpieces, said round dryer having a work container in which the workpieces pass through a helically revolving workpiece passage in a conveying direction. Such round dryers are known from the prior art and bring about a circulation of the workpieces by vibrating the work container.

Most of the process technologies in vibratory grinding take place using process water since this cleans the workpieces of material removal and of the inherent abrasion of the grinding bodies. The workpiece surface is hereby wet after the vibratory grinding and usually cannot be directly further processed or temporarily stored. Therefore, the workpieces are subsequently dried since this saves a wet intermediate passivation. Dry parts can be directly mounted, stored or easily moved in supply systems. Also, from a visual and/or technical point of view, it may be necessary to have stain-free parts at the same time.

Drying systems are known that work with hot air (working temperatures of approximately 80-120° C. and more depending on the system). The necessary effect can only be achieved in these systems with a considerable energy input (mainly electric current) and thus a lot of heat and air, which results in a poor energy balance.

It is therefore the object of the present invention to provide a round dryer by which a considerably improved energy balance can be achieved with an at least unchanging drying result.

This object is satisfied by the features of claim 1 and in particular in that the work container is closed at its upper side and in that a heating device is provided that sucks air out of the work container, heats and dehumidifies it, and that returns the heated and dehumidified air having a maximum temperature of 75° C. into the work container.

It has been recognized in accordance with the invention that, on the one hand, the use of dehumidified air and, on the other hand, the closing of the work container at its upper side can be sufficient to lead hot air having considerably reduced temperatures of a maximum of 75° C. through the work container. If a closed circuit is in this respect provided that supplies the air sucked out of the work container to the heating device for dehumidification and for heating so that it can be fed back into the work container, the energy requirement necessary for the drying can be reduced drastically (down to one third), whereby a saving of up to 70% $CO_2$ compared to conventional drying applications is simultaneously possible.

Advantageous embodiments are described in the description, in the drawing, and in the dependent claims.

In accordance with a first advantageous embodiment, the work container can have a thermal insulation, for example in the region of the peripheral wall, of a cover, and/or of the base of the work container. In connection with the closed design of the upper side of the work container, the energy saving on the drying can be considerably improved. At the same time, a sound absorption can hereby be achieved so that a soundproof cabin can be dispensed with.

In accordance with a further advantageous embodiment, the round dryer can be configured such that the outer side of the work container reaches a maximum temperature of approximately 40° C. in operation. Not only the heat energy required for the operation is hereby limited, but it is simultaneously ensured that operators cannot burn themselves when touching the work container. A protective fence or the like is thus not required.

In accordance with a further advantageous embodiment, at least one hot air supply can be provided at a base of the work container. The dehumidified hot air can hereby flow through the work container from the bottom to the top. If two hot air supplies are provided diametrically oppositely disposed at the base of the work container, a uniform air distribution is ensured.

In accordance with a further advantageous embodiment, at least one hot air outlet can be provided at the upper side of the work container so that the dehumidified hot air can uniformly flow through the work container from the bottom to the top and can thereby heat and dry the workpieces. It can be advantageous in this respect if the hot air supply or supplies and the hot air outlet or outlets are arranged offset from one another in a plan view since as uniform as possible a distribution of the dehumidified hot air within the work container is hereby provided.

In accordance with a further advantageous embodiment, the conveying direction, i.e. the direction in which the workpieces revolve helically within the workpiece passage, and the flow direction of the hot air can extend substantially transversely to one another, which ensures a uniform and good heat exchange.

In accordance with a further advantageous embodiment, at least one circulating air blower can be provided in addition to the heating device in order to increase the air input into the work container. In this respect, the circulating air blower can generate an air flow that extends in counterflow to the conveying direction in order to bring about an optimized drying. Such a circulating air blower can in particular be regulated in the rotational speed so that variable air volumes can be introduced into the work container in dependence on the respective requirement.

In accordance with a further advantageous embodiment, a circulating air supply can be provided at a peripheral wall of the work container to blow circulating air into the workpiece passage. In particular if the circulating air supply takes place at least approximately tangentially, the circulating air blown in is moved within the work container in the peripheral direction so that it can sweep over the workpieces on the workpiece passage revolving helically within the work container.

If a circulating air suction is provided in the region of the container base, the hot air likewise introduced in the region of the container base can be sucked in at a point at which it has its highest temperature and its lowest moisture content.

In accordance with a further advantageous embodiment, the base of the workpiece passage can be permeable to air to increase the drying effect. The base of the workpiece passage can in particular have a wire mesh or be manufactured from a wire mesh, which further promotes the drying process. Alternatively, perforated metal sheets, mesh grids, expanded metal gratings, structured metal sheets or the like can be provided.

If the base of the workpiece passage is coated with plastic, not only a gentle treatment of the workpieces is achieved, but also a drastic reduction of the sound level occurring in operation.

In accordance with a further advantageous embodiment, the workpiece passage can have a pre-drying zone in which a blow-off device is provided to blow off the workpieces with compressed air. Such a device can be arranged in an advantageous manner on the entry of the workpieces into the workpiece passage, wherein the base of the workpiece passage is configured as impermeable to liquid in this region to prevent a dripping of the liquid onto workpieces disposed therebelow. In this case, it may also be advantageous to provide a separate water outlet in the base region of the blow-off device.

In accordance with a further advantageous embodiment, the workpiece passage can have a step section by which it is achieved that the workpieces cover a free fall over a certain distance. The possibility hereby exists that the workpieces rotate or are turned, which is in particular advantageous with areal parts (for example, coins) or with scoop-like parts.

All metals and their alloys as well as plastics, ceramics or wood can be considered as materials for the workpieces. Stamped parts, cast parts, shaped parts, but also workpieces produced by additive manufacturing are suitable as workpieces.

With the round dryer in accordance with the invention, the drying process can be carried out without the use of drying agents (granulates, textiles or the like), whereby no costs for procurement, replacement, disposal, or maintenance are incurred. In addition to an unrestricted process repeatability, the workpieces and their surroundings are hereby also free of drying agent residues so that no dust suction or air suction is required.

Due to the comparatively low temperature of the hot air introduced, a workpiece temperature after the drying process can be reached that is below approximately 45° C., whereby texture changes, structure changes, or surface changes are excluded. Changes of protective layers (corrosion protection) or optical changes in brightness and/or color are also not brought about. The round dryer in accordance with the invention is also in particular suitable for surface-sensitive workpieces such as workpieces manufactured in additive processes.

Due to the low drying temperatures, a direct further processing or a packaging of the workpieces is possible. At the same time, there is no risk of injury and no danger to employees since neither the workpieces nor the work container poses a risk for burning. Finally, an inadmissible or unwanted influencing of the environment by radiant heat and air humidity is also avoided.

The round dryer in accordance with the invention can be equipped with a control and a heating device by which the drying temperature can be variably set and regulated respectively. The dehumidified hot air can be provided by a condensate drying unit that can in particular have a heat pump.

Figure 2:
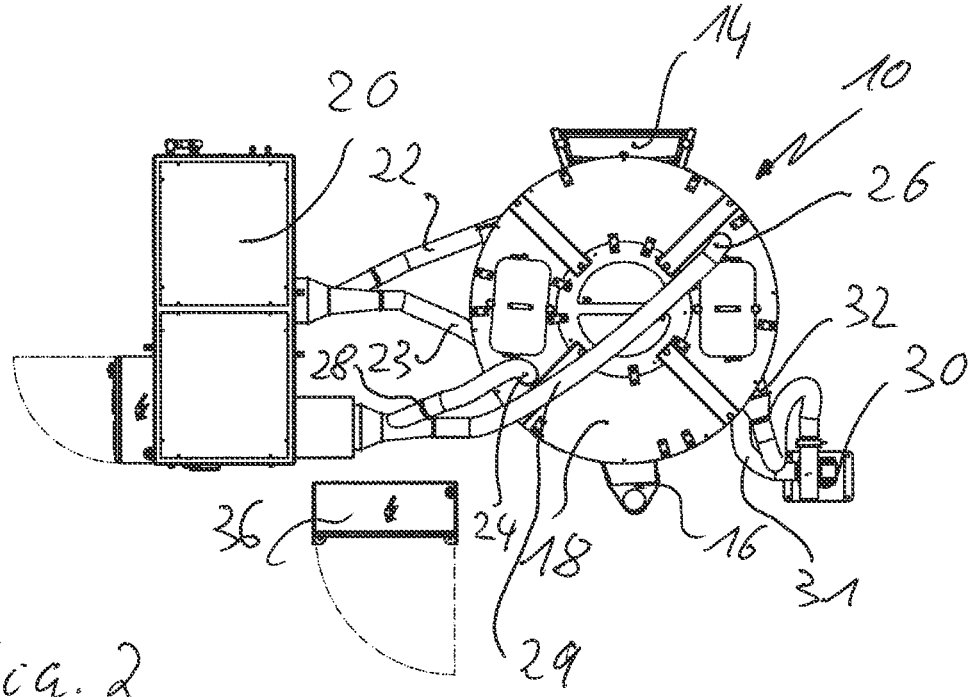

The present invention will be described in the following purely by way of example with reference to an advantageous embodiment and to the enclosed drawings. There are shown:

FIG. 1: a perspective view of a round dryer with a heating device;

FIG. 2: a plan view of the arrangement of FIG. 1; and

Figure 3:
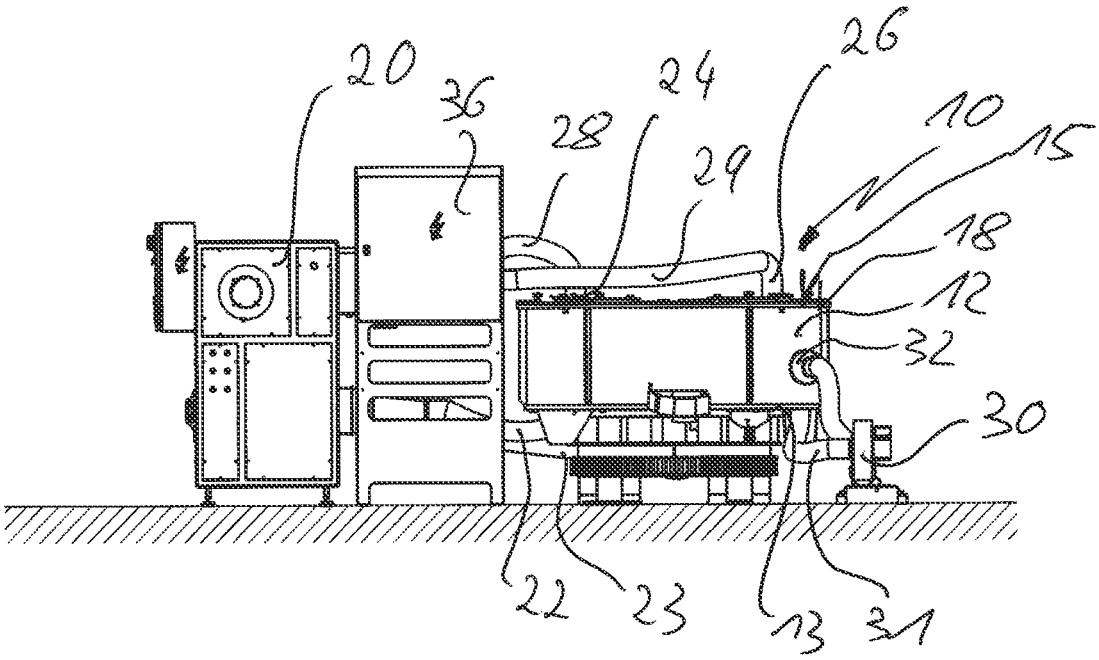

FIG. 3: a side view of the arrangement of FIG. 1.

The Figures show a round dryer 10 for drying workpieces that has a generally cylindrical work container 12 in which a helically revolving workpiece passage (not shown) is provided. Workpieces to be dried are introduced through a workpiece inlet 14, provided at the outer wall of the work container, into the work container 12 or at the start of its workpiece passage. Due to the vibration of the resiliently supported work container 12 with the aid of at least one unbalance motor, the workpieces then reach a workpiece outlet 16 at the lower side of the outer wall of the work container 12. In the embodiment shown, the workpiece passage itself is formed from a wire mesh that is coated with polyurethane and that helically revolves around the inner periphery of the work container via approximately two and a half revolutions over a distance of approximately 9.5 m. However, it is understood that the length and the width of the workpiece passage and its coating are variable. A workpiece supply can also take place through the upper side or a cover of the work container.

As the Figures illustrate, the work container 12 is completely closed at its upper side, which is achieved in the embodiment shown by a cover 18 that is screwed to the container wall in a thermally sealing manner. Alternatively, the cover can also be formed in one piece with the container wall.

Furthermore, the round dryer 10 shown in the Figures has a heating device 20 in which heated and dehumidified air having a maximum temperature of 70° C. is provided. This dehumidified air is guided from the heating device 20 via two air hoses 22 and 23 provided with a thermal insulation and via thermally insulated pipes to a respective hot air supply at the base 13 (FIG. 3) of the work container 12. In this respect, the two hot air supplies are arranged diametrically oppositely disposed at the base 13 of the work container 12.

After the introduction into the work container 12, the supplied, heated, and dehumidified air flows in a vertical direction through said work container 12 from the bottom to the top, which is facilitated by the air-permeable design of the workpiece passage. For the suction of the hot air that has flowed through the work container 12, two diametrically oppositely disposed hot air outlets 24 and 26 are provided at the upper side 15 of the work container 12 and are in turn connected to the heating device 20 via air hoses 28 and 29 provided with a thermal insulation and via thermally insulated pipes, whereby a closed air circuit is provided. For a good flowing through within the work container 12, the hot air supplies and the hot air outlets are arranged offset from one another, viewed in a plan view, and are in particular distributed uniformly over the periphery.

To increase the air input into the work container 12, an optional circulating air blower 30 is provided in the embodiment shown that sucks in air from the base 13 (FIG. 3) of the work container 12 via an air hose 31 and blows it into the work container 12 in counter-flow to the conveying direction of the workpieces. For this purpose, a circulating air supply 32, by which the circulating air can be blown at least approximately tangentially into the workpiece passage, is provided at the peripheral wall of the work container 12. The circulating air supply 32 is located approximately at the center of the work container, i.e. at half the height, so that warm hot air, which has been sucked in from the base of the work container, is introduced into the upper region of the work container in counter-flow. A second closed air circuit is thus provided by the circulating air blower 30.

The reference numeral 36 designates an electric switch cabinet. In this switch cabinet, a control for the round dryer can be provided by which, among other things, the rotational speed of the unbalance motors can be controlled, the amplitude of the vibration of the work container can be measured, and the preparation of the air guided through the work container can be regulated. The temperature of the workpieces in the workpiece passage can be measured contactlessly and a monitoring device can be provided that outputs a signal if no more workpieces are located in the workpiece passage. It can hereby be avoided that different batches are accidentally mixed. Furthermore, a separation device that prevents hot air from escaping from the work container 12 can be provided in the region of the workpiece inlet 14 and/or in the region of the workpiece outlet 16. Such a separation device can, for example, comprise a curtain or individual flaps composed of plastic or rubber or the like.

The invention claimed is:

1. A round dryer for drying workpieces, said round dryer comprising:

a work container having an upper side, the work container being closed at its upper side and in which work container the workpieces pass through a helical workpiece passage in a conveying direction;

a closed heating air circuit with a heating device that sucks air out of the work container, heats and dehumidifies the work container, with the heating device configured to return the heated and dehumidified air having a maximum temperature of 75° C. into the work container; and a closed circulating air circuit with at least one circulating air blower, a circulating air suction that is provided in the region of a container base and a circulating air supply that is provided at a peripheral wall of the work container.

2. The apparatus in accordance with claim 1, wherein the work container has a thermal insulation.

3. The apparatus in accordance with claim 1, wherein an outer side of the work container reaches a maximum temperature of 40° C. in operation.

4. The apparatus in accordance with claim 1, wherein at least one hot air supply is provided at a base of the work container.

5. The apparatus in accordance with claim 4, wherein two diametrically oppositely disposed hot air supplies are provided at the base of the work container.

6. The apparatus in accordance with claim 1, wherein at least one hot air outlet is provided at the upper side of the work container.

7. The apparatus in accordance with claim 6, wherein at least two diametrically oppositely disposed hot air outlets are provided at the upper side of the work container.

8. The apparatus in accordance with claim 4, wherein at least one hot air outlet is provided at the upper side of the work container and the hot air supply and the hot air outlet are arranged offset from one another in a plan view.

9. The apparatus in accordance with claim 1, wherein a conveying direction and a flow direction of the hot air extend transversely to one another.

10. The apparatus in accordance with claim 1, wherein the circulating air blower generates an air flow that extends in counter-flow to the conveying direction.

11. The apparatus in accordance with claim 1, wherein the circulating air supply is configured to blow circulating air at least approximately tangentially into the workpiece passage.

12. The apparatus in accordance with claim 1, wherein a base of the workpiece passage is at least partly permeable to air.

13. The apparatus in accordance with claim 12, wherein the base of the workpiece passage has wire mesh.

14. The apparatus in accordance with claim 1, wherein a base of the workpiece passage is coated with plastic.

15. The apparatus in accordance with claim 1, wherein the workpiece passage has a pre-drying zone in which a blow-off device is provided.

16. The apparatus in accordance with claim 1, wherein the workpiece passage has a step section.

* * * * *